US005133521A

United States Patent [19]

Gutauskas

[11] Patent Number: 5,133,521

[45] Date of Patent: Jul. 28, 1992

[54] RAILROAD FLAT WHEEL DETECTORS

[75] Inventor: Paul L. Gutauskas, Markham, Canada

[73] Assignee: SEL Division, Alcatel, Canada, Don Mills, Canada

[21] Appl. No.: 728,205

[22] Filed: Jul. 10, 1991

[51] Int. Cl.[5] ..... B61L 1/00

[52] U.S. Cl. ..... 246/169 R; 246/247

[58] Field of Search ..... 246/169 R, 169 D, 169 S, 246/247, 249, DIG. 1; 340/942; 73/146

[56] References Cited

U.S. PATENT DOCUMENTS

| | | | |
|---|---|---|---|
| 2,429,266 | 10/1947 | Gieskieng | 246/169 R |
| 3,086,109 | 4/1963 | Kaehms | 246/247 X |
| 3,504,173 | 3/1970 | Brinker | 246/247 X |
| 3,558,875 | 1/1971 | Gieskieng | 246/249 X |
| 3,844,513 | 10/1974 | Bernhardson et al. | 246/169 R |
| 3,972,021 | 7/1976 | Leitz et al. | 340/942 |
| 4,058,279 | 11/1977 | Frielinghaus | 246/169 R |
| 4,129,276 | 12/1978 | Svet | 246/169 S |
| 4,283,031 | 8/1981 | Finch | 246/247 X |
| 4,407,072 | 10/1983 | Hoskins, Jr. | 246/169 R X |
| 4,524,932 | 6/1985 | Bodziak | 246/247 |
| 4,696,446 | 9/1987 | Mochizuki et al. | 246/169 R X |
| 4,701,866 | 10/1987 | Harrison et al. | 246/169 R X |
| 4,781,060 | 11/1988 | Berndt | 246/169 R |
| 4,936,529 | 6/1990 | Maine | 246/169 R |

OTHER PUBLICATIONS

"Bad Wheels Spotted in Motion", Railway Age, Dec. 16, 1963, pp. 23 and 30.

*Primary Examiner*—Robert J. Spar
*Assistant Examiner*—Scott L. Lowe
*Attorney, Agent, or Firm*—Ware, Fressola, Van Der Sluys & Adolphson

[57] ABSTRACT

A railroad flat wheel detector having a housing anchored to one side of a railroad rail enclosing an arrayed plurality of light source-photodetector pairs whose respective optic axes are tangent to the locus of the lower rim edge of passing wheels rolling along the track. The photodetector outputs are operatively connected to trigger a flat wheel alarm when the increased wheel flange rim overlap with the supporting rail, caused by a flat sector of a passing wheel, obscures a portion of the light and thereby briefly reduces the light intensity sensed by one or more of the plurality of photodetectors.

10 Claims, 2 Drawing Sheets

RAILROAD FLAT WHEEL DETECTORS

FIELD OF THE INVENTION

This invention relates to detectors for identifying railroad wheels having flat sectors caused by skidding resulting from the emergency application of brakes, for example, and particularly to stationary detector systems for installation in transit system storage yards and railroad classification yards by which all wheels of every passing train may be monitored and flat wheels identified for replacement.

RELATED ART

The need for reliable flat wheel detection systems for railroad wheels is reflected in a number of prior art patents proposing particular systems, wherein impact stresses and shock loading on rails and rolling stock are described as reflecting the urgent need for reliable flat wheel detector systems.

Bernhardson U.S. Pat. No. 3,844,513 and Frielinghaus U.S. Pat. No. 4,058,279 both describe electrical continuity sensors in which flat wheels are detected when the rotating wheel, arriving with its flat sector passing the point of tangency with the rail, acts to "hop" away from the rail, thus interrupting electrical continuity from the rail through the wheel-axle pair to the opposite rail of the track. An acoustic sensor for flat wheels is described in Svet U.S. Pat. No. 4,129,276, and a strain gage type of rail accelerometer capable of sensing flat wheel impacts is described in Berndt U.S. Pat. No. 4,781,060.

All of these prior art flat wheel detectors are more sensitive to the presence of flat railroad wheels when the train is travelling rapidly down the track, and much less sensitive when the train is moving at slow speeds through the classification yard, where the amplitude of "hopping" might be negligible, the sound produced by a flat wheel might be virtually silent at slow speeds, and the flat wheel impact acceleration might likewise be negligible.

SUMMARY OF THE INVENTION

The detectors of the present invention do not rely upon major shock loads, loud sounds or high hops to identify railroad wheels having flat sectors. Instead, the detectors of this invention will identify flat wheels passing at any speed. The flat wheel detectors of this invention sense the greater radial distance between the wheel flange rim and the central portion of the flat sector on any railroad wheel having a significant flat portion on its tread. Whether it is passing at low speed or high speed, the flat sector of such a railroad wheel will exhibit a greater flange rim overlap with the rail since its effective tread radius, measured from its axis of rotation, is reduced to a value less than normal in the flat region while the rim diameter of the wheel flange remains a constant.

This increase in wheel flange overhang below the top of the supporting rail is identified by the obscuring or occulting interposition of the overhanging wheel flange rim into a beam of light travelling from a light emitting device such as an LED to a photodetector. To ensure that the entire periphery of every passing wheel is monitored by the system, a substantial plurality of LED-photodetector pairs are arrayed along a length of rail exceeding the circumference of all normal railway wheels. As a result, whenever a flat wheel passes the detector with its flat sector arriving at the supporting rail, the lowered rim flange reduces the amount of LED radiation detected by one or more photocells, producing a signal which can be used to trigger a paint spray, a flat wheel marking device, or to record data identifying the wheel, the vehicle and the train for future interception and wheel replacement.

Accordingly, a principal object of the present invention is to provide a dependable detector system for identifying railroad wheels having flat sectors.

Another object of the invention is to provide stationary automatic flat wheel detectors which can be installed beside a railroad track for monitoring every passing train, not requiring high impact loading or loud impact sounds to identify flat wheels.

A further object of the invention is to provide such flat wheel detection systems which operate effectively without regard to the speed of the passing train.

Other objects of the invention will in part be obvious and will in part appear hereinafter.

The invention accordingly comprises the features of construction, combination of elements and arrangement of parts which will be exemplified in the construction hereinafter set forth, and the scope of the invention will be indicated in the claims.

For a fuller understanding of the nature and objects of the invention, reference should be made to the following detailed description taken in connection with the accompanying drawings.

THE DRAWINGS

Figure 3:
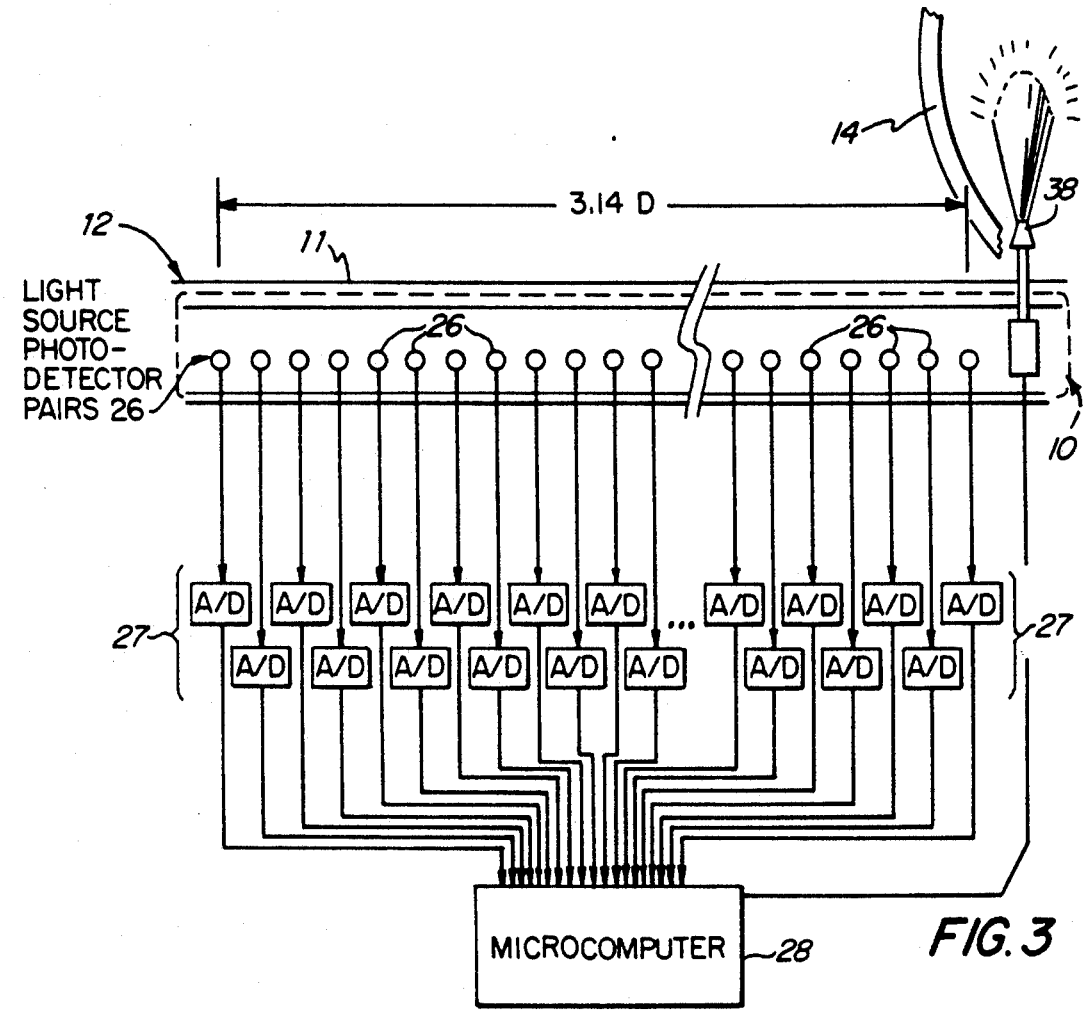
Figure 4:
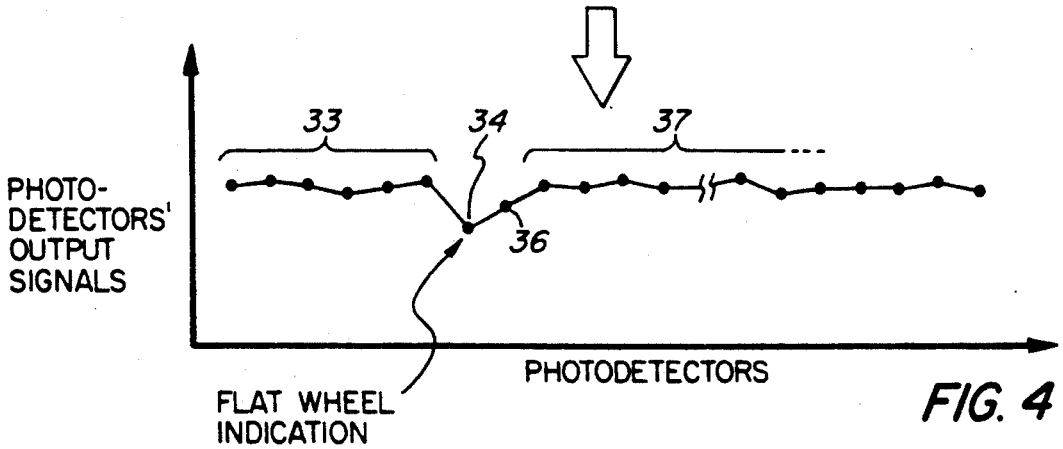

FIG. 3 is a schematic wiring diagram showing an arrayed plurality of LED-photodetector pairs each delivering their output signals to respective analog/-digital converters, the outputs of all of which are delivered to a microcomputer; and FIG. 4 is a graphical output diagram showing the output signals produced by all of the LED-photodetector pairs during the monitoring of the passage of a single wheel with the obstructed radiation reaching one photodetector being indicated by a low amplitude signal reflecting the presence of a flat sector on this particular wheel.

BEST MODE FOR CARRYING OUT THE INVENTION

As shown in the figures, the flat wheel detector systems of the present invention are preferably mounted inside a housing 10 positioned beside and secured to one rail of a railroad track and projecting upward at a short distance from the ball of the rail, with a plurality of light sources positioned beside the flange rim of each passing railroad wheel. A suitable housing 10 is shown schematically in the cross sectional end elevation view of FIG. 2 and in dash lines in the schematic side elevation view of FIG. 3, where it encloses the light sources and photodetectors employed in the systems of this invention.

Figure 1:
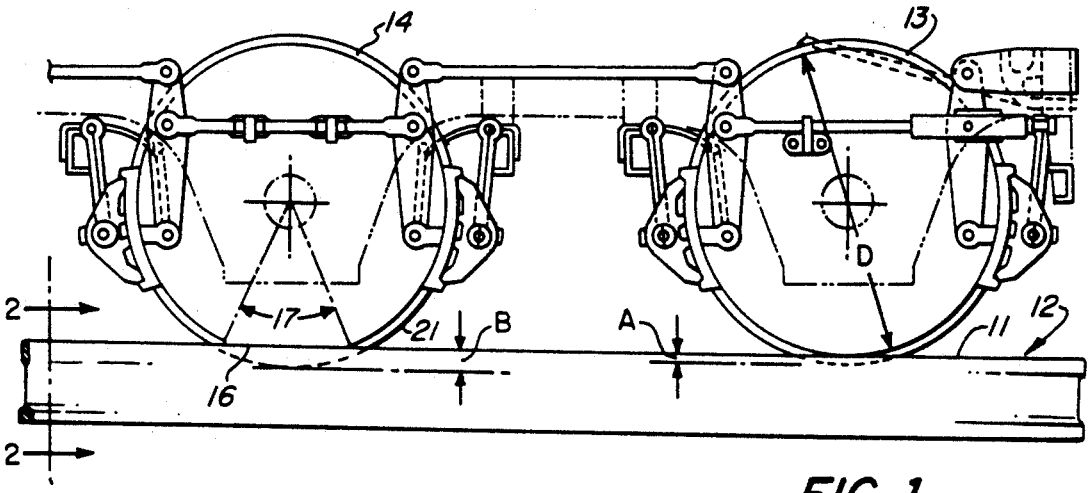
FIG. 1 is a schematic side elevation view of a pair of railroad wheels rolling on a railroad rail, one of which wheels has a flat sector.
Figure 2:
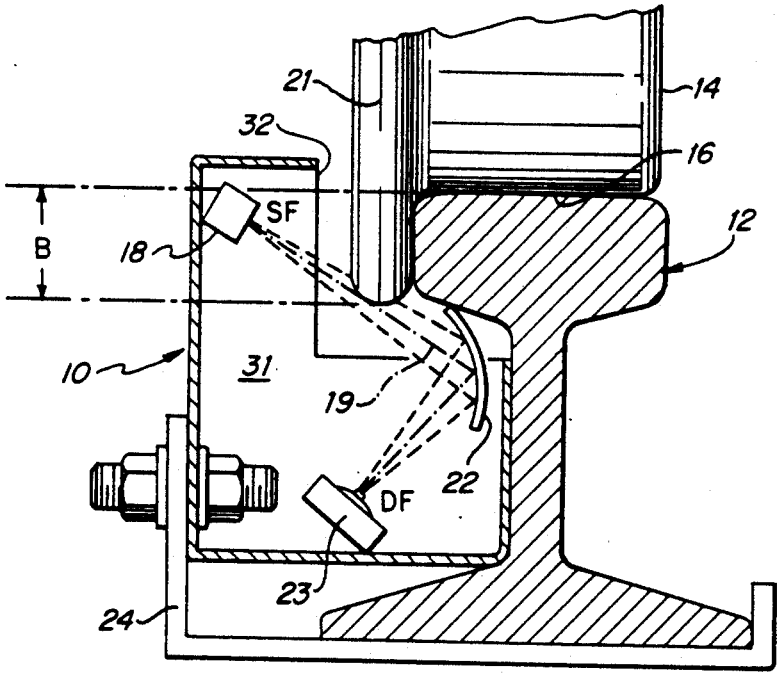
FIG. 2 is a corresponding end elevation view showing one of the wheels of FIG. 1 and its supporting rail with the position of applicant's light source or LED close to the wheel flange rim delivering radiation to the photodetector in one of the LED-photodetector pairs incorporated in the detector systems of the present invention.

The extent of rim flange overlap or overhang, extending downward below the level of the uppermost tread surface 11 of rail 12 is illustrated in FIGS. 1 and 2. In FIG. 1, the normal wheel 13 with no appreciable flat on its rim exhibits an overhang or overlap A beside the tread surface 11 of the rail 12 illustrated at the right hand side of FIG. 1. Flat wheel 14 with a flat zone 16 extending over a flat sector 17 comprising a minor part of the total circumference of flat wheel 14 presents a much larger overlap or overhang B, as shown on the left hand side of FIG. 1, exaggerated for emphasis. The same flat overhang B is also shown in FIG. 2. At speeds normally encountered in railroad classification yards and transit system storage yards, the flat zone 16 of wheel 14 will be moving slowly enough to come into brief resting engagement on tread surface 11 of rail 12, maximizing this overlap B for a brief period. However, the flat wheel detectors of this invention are effective regardless of train velocity.

OPTICAL DETECTOR SYSTEM

The light source and photodetector pairs comprising the plurality of optical detector systems employed in each unit of the present invention are shown schematically in FIG. 2, where a light source such as a light emitting diode 18 is positioned in the outermost upper portion of housing 10, with its light output directed along an optic axis 19 extending diagonally downward beneath and virtually tangent to the wheel flange rim 21 of each passing railroad wheel 13, 14, etc. As the light radiating from LED 18 at source focus SF passes beneath rim 21 and into the space under the ball of rail 12, it is aimed to reach a concave reflector 22 which redirects the light from LED 18 and focuses it upon a photodetector 23, at detector focus DF.

Reflector 22 is preferably ellipsoidal in configuration, with LED 18 being positioned at one focus SF and photodetector 23 being positioned at the other focus DF of the ellipsoid, and each aligned group of components 18, 22 and 23 are all firmly positioned with the capability for minor alignment adjustment inside housing 10, which itself is dimensioned for sturdy permanent mounting against the web of rail 12 by such means as the bolted clamp 24 shown in FIG. 2, secured to housing 10. Each end wall 31 of housing 10 is provided with a cut out portion 32, dimensioned to clear the rims of all passing wheels, as shown in FIG. 2.

As indicated in FIG. 3, a substantial number of light source-photodetector pairs are preferably arrayed inside housing 10, extending along the rail for a distance exceeding the normal circumference of the railroad wheels being monitored. It will be understood that the normal load bearing wheels of transit system vehicles, mainline railroad passenger cars and freight cars will customarily all be monitored by the systems of the present invention, while large diameter driving wheels of locomotives may customarily not be monitored, except at special installations associated with locomotive maintenance shops.

As indicated in FIG. 3, the entire array of light source-photodetector pairs 26 extends lengthwise along the rail over a distance equal to or greater than the wheel circumference 3.14D for the normal size wheels scheduled for monitoring. The output from each of the photodetectors in pairs 26 is delivered to respective individual analog-to-digital converters 27, whose outputs are all delivered to microcomputer 28, which also receives train identifying signals from such means as inputs from an automatic signalling system train tracking function, or bar code equipment positioned for scanning each passing train, not illustrated in the figures. If the flat wheel detection systems of the invention are installed in transit system storage yards or railroad classification yards, the train identifying data may be entered manually by dispatchers. It should be noted that the spacing of the light source- photodetector pairs 26 lengthwise along the housing 10 is selected to ensure that all significant flat spots are observed and recorded, and any flat spot subtending a predetermined minimum angle of flat sector 17 is not missed by the system.

The microcomputer 28 determines the relative change in light intensity received by each photodetector as the wheel 14 travels along the array inside housing 10 and the output of microcomputer 28 may be presented numerically or in the graphical form illustrated in FIG. 4, showing the relative change in light intensity received by each successive photodetector during the passage of wheel 14. The first six photodetectors, outputs 33 show minimal output variation, indicating a normal range of wheel wear while they monitor the first sample portion of the periphery of wheel 14. However the seventh photodetector output 34 has reported a sharp dip in light intensity corresponding to a significant obstruction of the light beam by the substantial overlap B produced by the flat 16 of wheel 14. The eighth photodetector output 36 shows that the wheel is climbing back onto its normal rim but a significant dip in received light intensity is still indicated. The balance of the photodetector outputs 37 over the entire array vary only within a normal range.

Thus wheels whose rims are worn over a range of normal radius measurements will produce only minimal light intensity variations, but significant wheel flats will produce a noticeable dip in light intensity as the light is obstructed by the overhanging rim 21 of any flat wheel such as wheel 14. This permits immediate marking of the flat wheel by such means as a paint spray 38 triggered by the microcomputer 28 to provide a blast of bright colored paint directed at the outer surface of wheel 14, which can then be easily identified as a flat wheel by maintenance personnel. Thus, the flat wheel detectors of this invention do not require high speeds, drastic hopping impact forces or accelerations or the loud sounds produced by such high speed flat wheel impacts, in order to identify and record the location of all flat wheels meeting the monitoring criteria.

Furthermore, these detectors may be conveniently located in stationary positions in classification or storage yards where slowly moving trains can be monitored for flat wheels without the risk of any such drastic hopping impacts or loud noise. By this means, damage to wheel bearings can be reduced or avoided by periodic regular monitoring operations of each passing train entering or leaving the classification yard, identifying flat wheels soon after they develop.

The analog photodetectors' output signals representing observed light intensities could be processed and compared directly in complex comparator circuitry. However, the use of a corresponding plurality of analog-to-digital converters 27, one for each photodetector, formed on one or a few integrated circuit chips, delivering their digital output signals 33–37 to a microcomputer 28 formed on another single integrated circuit chip, produces superior results with far more economical and compact circuitry.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A railroad flat wheel detector for stationary installation along one monitored rail of a railroad track a plurality of light sources arrayed parallel to the rail delivering light along respective optic axes each aimed along a path substantially tangent to the locus of the lower rim edge of each railroad wheel rolling along the track;

focusing means positioned to direct said light toward a detection focal point on its optic axis;

a corresponding plurality of photodetectors, each positioned at one said detection focal point to receive the light from one said light source;

and signal means operatively connected to the output of each said photodetector providing a flat wheel alarm signal in response to every observed reduction in light intensity received by said photodetectors, whereby the increased flange rim overlap at the flat sector of any flat wheel rolling past the stationary detector, intruding into and obstructing the light from one said light source, actuates a flat wheel alarm signal in response to the reduced output signal from the corresponding respective photodetector.

2. The flat wheel detector defined in claim 1 wherein each of the light sources is a light emitting diode.

3. The flat wheel detector of claim 1 wherein the focusing means is an ellipsoidal concave reflector having two focal points, with the light source being positioned at the first

4. The flat wheel detector of claim 3 wherein each respective photodetector and light source pair are positioned at the individual focal points of their respective associated ellipsoidal reflector.

5. The flat wheel detector of claim 1 wherein the output signals from each photodetector are delivered via a respective analog-to-digital converter to a microcomputer connected to actuate said flat wheel alarm.

6. The flat wheel detector of claim 5 wherein the microcomputer is connected to store all of said output signals in memory indexed by train identification data.

7. The flat wheel detector of claim 5 wherein the microcomputer is connected to identify each observed flat wheel by applying visible indicia thereto.

8. The flat wheel detector of claim 1 wherein the arrayed light source-photodetector pairs are enclosed within a detector housing firmly anchored to the monitored rail by removable clamping means.

9. The flat wheel detector of claim 8 wherein one detector housing is anchored to one rail of a track while another detector housing is anchored nearby to the other rail of the same track, providing monitoring for flat wheels on both sides of a train at substantially the same location.

10. A railroad flat wheel detector for stationary installation along one rail of a railroad track comprising an elongated housing anchored to the wheel-flange side of a railroad rail, having a length exceeding the circumference of standard railroad wheels;

a plurality of light sources arrayed parallel to the upper portion of the rail along the inside upper portion of the housing delivering light along respective optic axes aimed slanting downward toward the upper portion of the web of the rail along paths substantially tangent to the locus of the lower rim edge of each railroad wheel rolling along the track;

a corresponding plurality of concave reflectors arrayed in the housing respectively positioned to receive and reflect said light toward a detection focal point;

a corresponding plurality of photodetectors, each positioned within the housing at one said detection focal point to receive the reflected light from one said light source;

the upper portion of the housing being open to embrace the flange rim of every railroad wheel rolling along the track;

and signal means operatively connected to the output of each said photodetector providing a flat wheel alarm signal in response to every observed reduction in light intensity received by said photodetectors, whereby the increased flange rim overlap at the flat sector of any flat wheel rolling past the stationary detector, intruding into and obstructing the light from one said light source, actuates a flat wheel alarm signal in response to the reduced output signal from the corresponding respective photodetector.

* * * * *